US006281807B1

(12) United States Patent
Kynast et al.

(10) Patent No.: US 6,281,807 B1
(45) Date of Patent: Aug. 28, 2001

(54) METHOD FOR SELECTING DIGITAL TRAFFIC MESSAGES

(75) Inventors: Andreas Kynast, Hildesheim; Ulrich Kersken, Diekholzen, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/121,611

(22) Filed: Jul. 16, 1998

(30) Foreign Application Priority Data

Jul. 16, 1997 (DE) ..... 197 30 452

(51) Int. Cl.[7] ..... G08G 1/09

(52) U.S. Cl. ..... 340/905; 340/995; 340/988; 340/990; 701/208; 701/209

(58) Field of Search ..... 340/906, 905, 340/995, 988, 990, 992, 993; 701/208, 209

(56) References Cited

U.S. PATENT DOCUMENTS

| | | | | |
|---|---|---|---|---|
| 5,173,691 | * | 12/1992 | Sumner | 340/905 |
| 5,717,389 | * | 2/1998 | Mertens et al. | 340/928 |
| 5,724,644 | * | 3/1998 | Wassink et al. | 455/38.4 |
| 5,818,356 | * | 10/1998 | Schuessler | 340/995 |
| 5,864,305 | * | 1/1999 | Rosenquist | 340/905 |
| 5,906,654 | * | 5/1999 | Sato | 701/210 |
| 5,948,040 | * | 9/1999 | DeLorme et al. | 701/201 |

FOREIGN PATENT DOCUMENTS

| | | |
|---|---|---|
| 42 08 277 | 9/1993 | (DE) . |
| 196 06 010 | 8/1997 | (FR) . |

* cited by examiner

*Primary Examiner*—Jeffery Hofsass
*Assistant Examiner*—Toan Pham
(74) *Attorney, Agent, or Firm*—Kenyon & Kenyon

(57) ABSTRACT

A method for selecting digital traffic messages in a radio receiver, with traffic messages concerning previously selected routes and corridors along the routes being selected and output.

9 Claims, 1 Drawing Sheet

METHOD FOR SELECTING DIGITAL TRAFFIC MESSAGES

FIELD OF THE INVENTION

The present invention relates to a method for selecting digital traffic messages.

BACKGROUND INFORMATION

A road-traffic broadcasting receiver which is able to selectively reproduce traffic messages is described in German Patent Application No. 42 08 277. To do this, a route from a start point to a destination point is first defined in the road-traffic receiver and the traffic messages corresponding to locations along the calculated route selected. The vehicle driver is usually interested only in those traffic messages corresponding to events along his route. In some situations, however, this is insufficient if the driver would like to make a detour or take an alternative route, for example, when he encounters a large traffic jam. With a conventional road-traffic broadcasting receiver, it is not possible to also select those traffic messages which correspond to detours or to the immediate surroundings of the original route. In addition, the use of the conventional road-traffic broadcasting receiver requires that the exact route is defined and the start and destination points are known.

SUMMARY OF THE INVENTION

The method according to the present invention is advantageous in that the details of the route do not have to be known in order to select relevant traffic messages. Plane elements in which the traffic messages are selected are determined along the calculated route. This makes it possible to simplify the organization of the database used for the route finder.

Another embodiment of the method according to the present invention provides that corridors can be approximated by overlaying geometric planes, for example rectangular plane elements, thereby reducing computing power requirements and saving storage space.

Rectangular, in particular square, plane elements which, when combined, form corridors are used to advantage.

Plane elements which surround a location on the route lying outside the previously imposed plane element are combined in order to further optimize the computing power requirements for determining the corridors. This avoids over-defining the corridor, thereby saving time and computing power.

Several corridors of alternative routes are advantageously combined to form a common corridor and the traffic message in this corridor is analyzed.

In order to obtain information about traffic obstacles also in the vicinity of the start and destination points, a separate plane element is placed around the start and destination points, thereby making it possible to monitor the immediate surroundings. The plane element around the start point can be enlarged as a function of time in order to bridge the time needed to calculate the corridors.

To further minimize the computing power requirements, plane elements are combined, with the offset between adjacent elements being used as a criterion for combining the elements. This produces larger common plane elements which require less storage space and memory for further processing.

DETAILED DESCRIPTION

Figure 1:
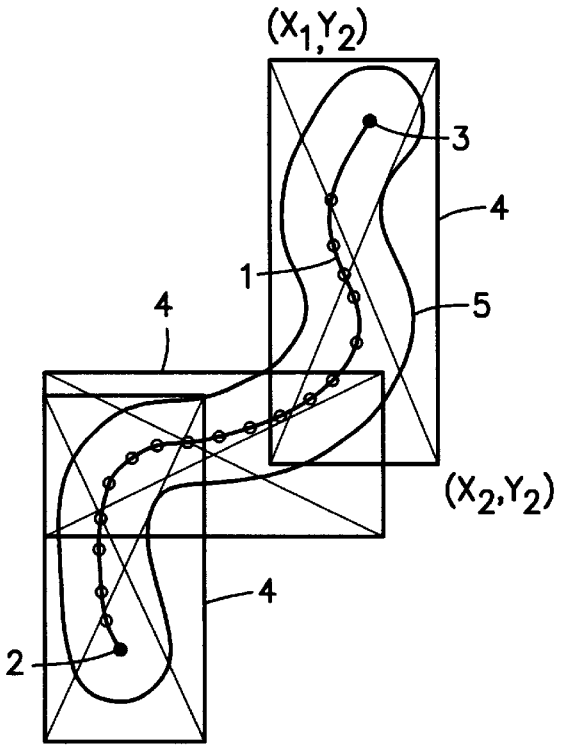
FIG. 1 shows a route with a tubular corridor.

FIG. 1 shows a route 1 between start point 2 and destination point 3. A tubular corridor 5 extends along this route 1 and runs equidistant from route 1. Plane elements 4 approximate the shape of tubular corridor 5. The plane elements are each determined by coordinates $(x_1, y_1)$ and $(x_2, y_2)$.

A receiver which is able to receive and store digital traffic messages is required in order to carry out a method according to the present invention. The traffic messages here can be provided in the form of TMC (traffic message channel) signals in the RDS (radio data system), in the form of supplementary data of the digital audio broadcasting system (DAB), or in the form of data transmitted directly via the GSM channel. The receiver must also be able to determine an optimum route and optional alternative routes from the start and destination points input. In order to carry out the method according to the present invention, the route must first be determined. The method described in German Patent Application No. 196 06 010 can be used for determining the route. Once the route has been determined, tubular corridor 5, which contains the possible detours and alternative routes, is ideally determined. The traffic messages present (e.g., received) in the receiver are analyzed on the basis of the locations within the corridor and converted to an output format for the user of the receiver.

The transition from a single route, with the traffic messages selected for this route alone, to a plane corridor is necessary in order for traffic messages on detours from the original route, for example when avoiding a traffic jam, to be taken into account. In addition, route finding and thus the selection of messages is possible even if the start and destination points are not precisely known or if they do not have to be entered exactly. Indicating a start or destination region is sufficient. The advantage of this is that receivers that do not have a positioning capability with the aid of GPS modules can be operated by entering place names or area names.

An ideal corridor should be set up so that its outer limits are always at an equal distance from the route. In most instances, this type of corridor 5 cannot be described with simple mathematical functions. A corridor is therefore emulated with geometric planes, for example rectangular plane elements 4, which can be described using coordinate pairs. This requires less storage space for storing the corridors and simplifies the comparison when selecting the traffic messages later on, taking into account deviations from the optimum tubular corridor shape.

The selected plane elements, the sum of which can span mathematical corridor 9, can also be circles, ellipses, trapezoids, triangles, etc.

Figure 2:
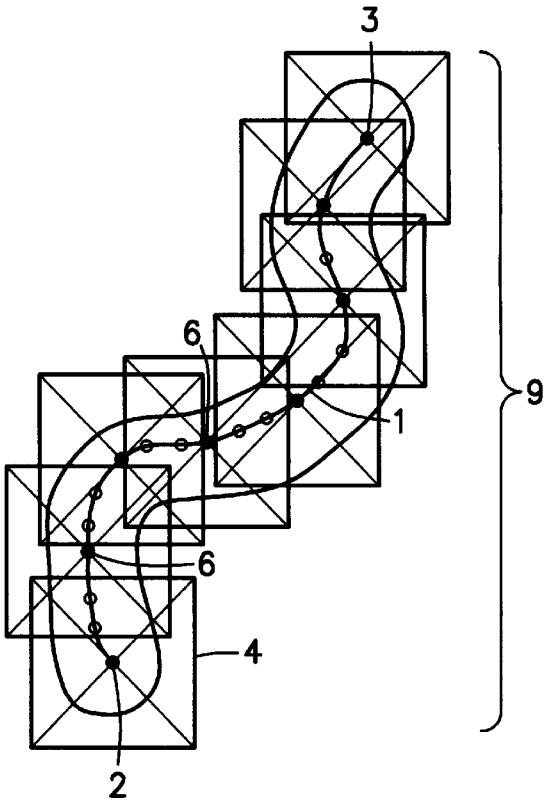
FIG. 2 shows the calculation of a corridor composed of plane elements according to the present invention.

FIG. 2 shows a planar corridor 9 stretching from start point 2 to destination point 3 constructed with the aid of square plane elements 4. The user enters destination point 3 and optionally start point 2 via an input device. These items are sent to a microprocessor in the receiver. If the receiver has a positioning module, the microprocessor determines the position without any input from the user being necessary. The microprocessor determines the values needed to find the route from the destination and start points. The route is determined in the microprocessor as a chain of locations that are stored in a database. A square plane element 4 is first placed around the start point of the route. Along the route, the microprocessor compares the coordinates of the individual locations to the coordinates of the first imposed plane element to determine whether the location still lies within first previously imposed plane element 4. First indicated location 6 lying outside the previously imposed plane element is then used as the central point for next square plane element 4. This procedure is repeated until destination point 3 has been reached. A separate plane element 4 is also placed around the destination point if the destination point lies within the last previously imposed plane element. This procedure for determining the planar corridors is used for all previously determined alternative routes. The final corridor is determined by overlaying, i.e. summing up, the individual corridors found for the alternative routes. A display and reproduction method described in German Patent Application No. 42 08 277 is selected for the relevant traffic messages in the final corridor. To make it easier for the user to enter the start and destination points, a method can be used in which a plane element which is larger than the other locations indicated along the route is placed around the start and/or destination point. By doing this, an adequately imprecise region is defined so that only a rough indication of the locations needs to be input.

Figure 3:
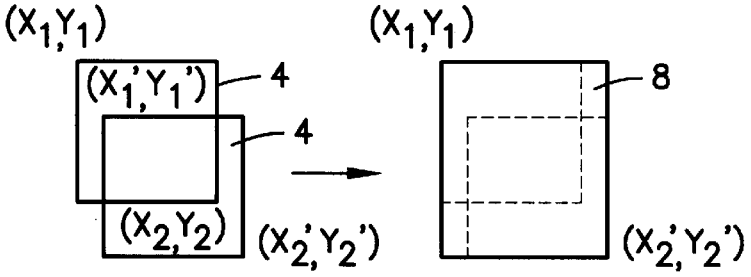
FIG. 3 shows a combination of plane elements.

FIG. 3 shows two plane elements 4 combined to form a single larger new plane element 8. Combining plane elements 4 to form larger plane elements 8 reduces the number of plane parameters to be stored. Adjacent plane elements, one coordinate pair of which is at a distance less than an offset 7 to be defined, are combined. This combination is not limited to two plane elements, but instead as many plane elements as allowed by the above criterion can be combined.

What is claimed is:

1. A method for selecting at least one digital traffic message in a radio receiver, comprising the steps of:

(a) selecting a route;

(b) forming a planar corridor around the selected route;

(c) selecting at least one digital traffic message as a function of the planar corridor; and (d) outputting the at least one selected digital traffic message.

2. The method according to claim 1, wherein step (b) includes the substep of:

adding plane elements around locations along the selected route, the sum of the plane elements encompassing the selected route to form the planar corridor.

3. The method according to claim 1, wherein the planar corridors are formed by rectangular plane elements encompassing locations along the selected route.

4. The method according to claim 3, wherein the rectangular plane elements include square plane elements.

5. The method according to claim 1, wherein the planar corridor is formed by individual plane elements, and further comprising the step of combining plane elements to form larger plane elements.

6. The method according to claim 1, wherein the planar corridor is formed by plane elements encompassing locations along the selected route, and further comprising the step of: (f) combining the plane elements, wherein the locations along the selected route are positioned outside of a preceding element of the plane elements.

7. The method according to claim 1, wherein the selected route includes a plurality of routes, wherein a plurality of planar corridors are formed by combining plane elements associated with each of the plurality of routes, and further comprising the step of combining the plane elements associated with the plurality of routes to form a single planar corridor.

8. The method according to claim 1, wherein the planar corridors are formed by combining plane elements, one of the plane elements positioned around a start point of the selected route, another one of the plane elements positioned around a destination point of the selected route.

9. The method according to claim 1, wherein the planar corridors are formed by combining plane elements associated with locations along the selected route, and further comprising the step of combining adjacent elements of the plane elements to form a common larger plane element as a function of a predetermined offset.

* * * * *